US011065638B2

(12) United States Patent
Hayama et al.

(10) Patent No.: US 11,065,638 B2
(45) Date of Patent: Jul. 20, 2021

(54) APPLICATION DEVICE

(71) Applicant: HONDA MOTOR CO., LTD., Tokyo (JP)

(72) Inventors: Hironobu Hayama, Tochigi (JP); Takeshi Nabeta, Tochigi (JP); Takashi Motohashi, Tochigi (JP); Chikanori Watanabe, Tochigi (JP); Takashi Yamamuro, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 55 days.

(21) Appl. No.: 16/334,645

(22) PCT Filed: Sep. 15, 2017

(86) PCT No.: PCT/JP2017/033569
§ 371 (c)(1),
(2) Date: Mar. 19, 2019

(87) PCT Pub. No.: WO2018/056227
PCT Pub. Date: Mar. 29, 2018

(65) Prior Publication Data

US 2020/0139396 A1 May 7, 2020

(30) Foreign Application Priority Data

Sep. 23, 2016 (JP) ..... JP2016-186214

(51) Int. Cl.

| | |
|---|---|
| ***B05C 5/02*** | (2006.01) |
| ***B05B 1/04*** | (2006.01) |
| ***B05B 13/04*** | (2006.01) |
| ***B05B 15/14*** | (2018.01) |
| ***B05C 17/005*** | (2006.01) |

(52) U.S. Cl.
CPC ..... *B05C 5/0254* (2013.01); *B05B 1/044* (2013.01); *B05B 13/0431* (2013.01);
(Continued)

(58) Field of Classification Search
CPC ... B29C 48/305; B29C 48/307; B05C 5/0283; B05C 5/0254; B05C 5/0291;
(Continued)

(56) References Cited

U.S. PATENT DOCUMENTS 5,223,276 A * 6/1993 Djordjevic ..... B29C 48/307 425/131.1

FOREIGN PATENT DOCUMENTS

| | | |
|---|---|---|
| JP | H03-16665 | 1/1991 |
| JP | H06-47669 | 2/1994 |

(Continued)

OTHER PUBLICATIONS

English Translation of JP2008-205059 published Sep. 4, 2008 (Year: 2008).*

(Continued)

*Primary Examiner* — Laura Edwards
(74) *Attorney, Agent, or Firm* — Rankin, Hill & Clark LLP

(57) ABSTRACT

A sealing agent (25) sent from a nozzle tube (36) to a nozzle main body (37) is passed through a main body flow channel portion (37*a*), a connecting portion (37*c*), a first flow channel portion (37*b*), and plural second flow channel portions (37*d*), sent to a chamber (37*e*), and discharged from a nozzle port (37*f*) to the outside. Since the second flow channel portions (37*d*) are smaller than a downstream end of the first flow channel portion (37*b*), the sealing agent (25) in the first flow channel portion (37*b*) is vigorously sent to the chamber (37*e*), and discharged from the nozzle port (37*f*) to the outside. As a result, substantially the same quantity of the sealing agent (25) is discharged in the entire range of the chamber (37*e*).

2 Claims, 6 Drawing Sheets

(52) U.S. Cl.
CPC ..... *B05B 15/14* (2018.02); *B05C 5/0204* (2013.01); *B05C 5/0216* (2013.01); *B05C 5/0283* (2013.01); *B05C 17/00516* (2013.01)

(58) Field of Classification Search
CPC ..... B05C 5/0204; B05C 17/00516; B05C 5/0216; B05B 1/044; B05B 15/14; B05B 13/0431
USPC ..... 118/410
See application file for complete search history.

(56) References Cited

FOREIGN PATENT DOCUMENTS

| | | |
|---|---|---|
| JP | 2000-334333 | 12/2000 |
| JP | 2006-122834 | 5/2006 |
| JP | 2008-205059 | 9/2008 |
| JP | 2014-069095 | 4/2014 |
| JP | 2016-043312 | 4/2016 |
| WO | 2014/038208 | 3/2014 |

OTHER PUBLICATIONS

English Translation of JP2006-122834 published May 18, 2006 (Year: 2006).*
English Translation of JP2000-334333 published Dec. 5, 2000 (Year: 2000).*
International Search Report, dated Dec. 5, 2017 (Dec. 5, 2017), 2 pages.

* cited by examiner

APPLICATION DEVICE

TECHNICAL FIELD

The present invention relates to a coating apparatus which applies a viscous material such as a sealing agent.

BACKGROUND ART

For a vehicle body plate or the like of a body of an automobile, two vehicle body plates are laminated in some cases. In such a case, even when the accuracy of each of the vehicle body plates to be laminated is within a tolerance, a gap is formed between an end portion of one of the vehicle body plates and a surface of the other vehicle body plate due to combined allowable errors. If the gap remains, there is a problem that water leakage or rust occurs from that part, or the appearance is impaired when the gap can be seen from the outside of the vehicle body. Therefore, the gap is applied with a sealing agent to prevent the rust and improve the appearance.

As a coating apparatus which applies a viscous material such as a sealing agent on an object to be coated, for example, a coating apparatus described in Patent Literature 1 laminates a second plate material on a first plate material, and a viscous material is discharged from a discharge port of a nozzle to apply the viscous material to the laminated portion between the first plate material and the second plate material.

CITATION LIST

Patent Literature

Patent Literature 1: Japanese Patent Laid-Open No. 2016-043312

SUMMARY OF INVENTION

Technical Problem

In the coating apparatus described in Patent Literature 1, a flow channel which is formed so as to penetrate through the inside of the nozzle and through which the viscous material flows has an elongated rectangular cross-sectional shape. In the case of such an elongated rectangular shape, the flow velocity of the viscous material flowing through the flow channel is lower at an end portion in contact with a longitudinal wall surface of the flow channel due to the contact resistance between the viscous material and the longitudinal wall surface than that at a center portion at which the viscous material is not in contact with the longitudinal wall surface. Therefore, the discharge quantity from the end portion in the longitudinal direction of the discharge port is smaller than the discharge quantity from the center portion. When the discharge quantity of the viscous material is different between the end portion and the center portion, it is impossible to uniformly apply the viscous material.

The present invention has been made in view of such circumstances, and has an object to provide a coating apparatus capable of uniformly applying a viscous material.

Solution to Problem

A coating apparatus according to the present invention has a flow channel through which a viscous material flows, comprises a nozzle configured to discharge the viscous material flowing through the flow channel, and applies the viscous material discharged from the nozzle to an object, wherein the flow channel comprises: a first flow channel portion through which the viscous material flows; a plurality of second flow channel portions which are smaller than a downstream end of the first flow channel portion and intercommunicate with the downstream end of the first flow channel portion so as to cause the viscous material flowing from the first flow channel portion to flow therethrough; and a discharge portion that intercommunicates with all of downstream ends of the plurality of second flow channel portions and discharges the viscous material flowing from the plurality of second flow channel portions.

According to the present invention, since the second flow channel portions are smaller than the downstream end of the first flow channel portion, the viscous material in the first flow channel portion passes through the second flow channel portions, and is vigorously sent to the discharge portion and discharged to the outside. As a result, the discharge quantity of the viscous material at a portion close to the wall surface of the end portion of the discharge portion is never smaller than that at a center portion, and substantially the same quantity of viscous material can be discharged over the entire range of the discharge portion, so that the viscous material can be uniformly applied.

Furthermore, it is preferable that the flow channel comprises an upstream-side flow channel portion that is provided on an upstream side of the first flow channel portion and is larger than an upstream end of the first flow channel portion, and causes the viscous material to flow to the first flow channel portion.

According to this configuration, since the upstream end of the first flow channel portion is smaller than the upstream-side flow channel portion, pressure is applied to the viscous material inside the first flow channel portion. As a result, the viscous material can be caused to vigorously flow from the first flow channel portion to the second flow channel portions.

Furthermore, it is preferable that a downstream end of the discharge portion is formed in an elongated shape, an upstream end of the nozzle is formed in a circular shape, and a downstream end of the nozzle is formed in an elongated shape corresponding to the discharge portion.

According to this configuration, the tip portion of the nozzle can be made smaller than the rear end portion thereof. As a result, the tip of the nozzle can be inserted into a narrower site as compared with a case where the tip portion and the rear end portion have the same shape.

Advantageous Effect of Invention

According to the present invention, the viscous material can be uniformly applied.

DESCRIPTION OF EMBODIMENT

Hereinafter, an embodiment of the present invention will be described with reference to the drawings.

Figure 1:
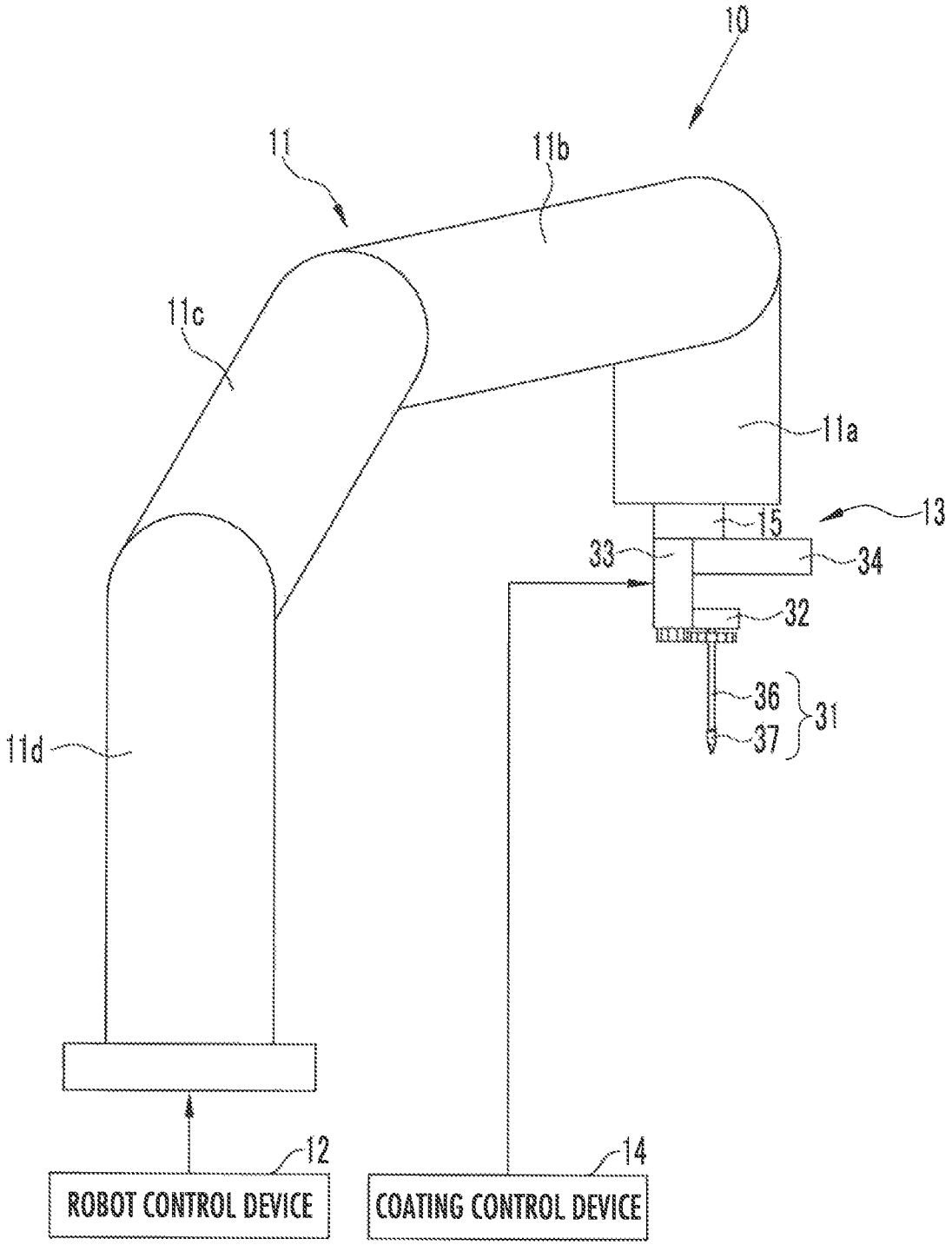
FIG. 1 is a side view showing a coating apparatus of the present invention.

As shown in FIG. 1, a coating apparatus 10, i.e. an application device, comprises a coating robot 11, a robot control device 12, a coating unit 13, and a coating control device 14.

The coating robot 11 is, for example, a multi-axis articulated robot, and is provided with arms 11*a* to 11*d* in order from the tip. The coating robot 11 is provided with plural motors (not shown) configured to drive the joints (not shown) of the respective arms 11*a* to 11*d*, and the driving thereof is controlled by the robot control device 12.

A mounting portion 15 is attached to the arm 11*a* on the tip side of the coating robot 11, and the coating unit 13 is mounted on the mounting portion 15.

The robot control device 12 drives the plural motors of the coating robot 11 to drive the arms 11*a* to 11*d* so as to move the coating unit 13 mounted on the mounting portion 15 to a position facing a coating target.

Figure 2:
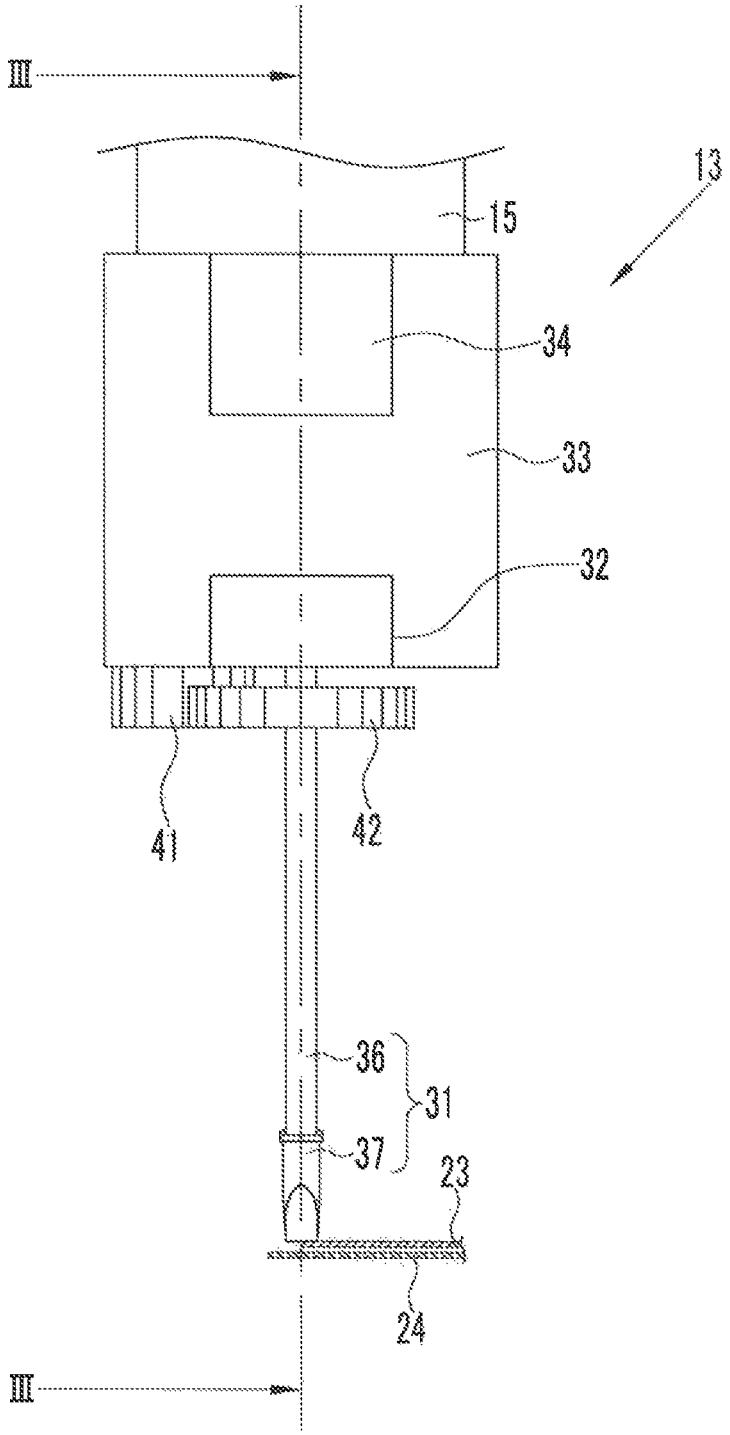
FIG. 2 is a front view showing a coating unit.

As shown in FIG. 2, the coating unit 13 applies a sealing agent 25 (see FIG. 4) to, for example, the gap between two vehicle body plates 23 and 24 constituting the vehicle body.

Figure 3:
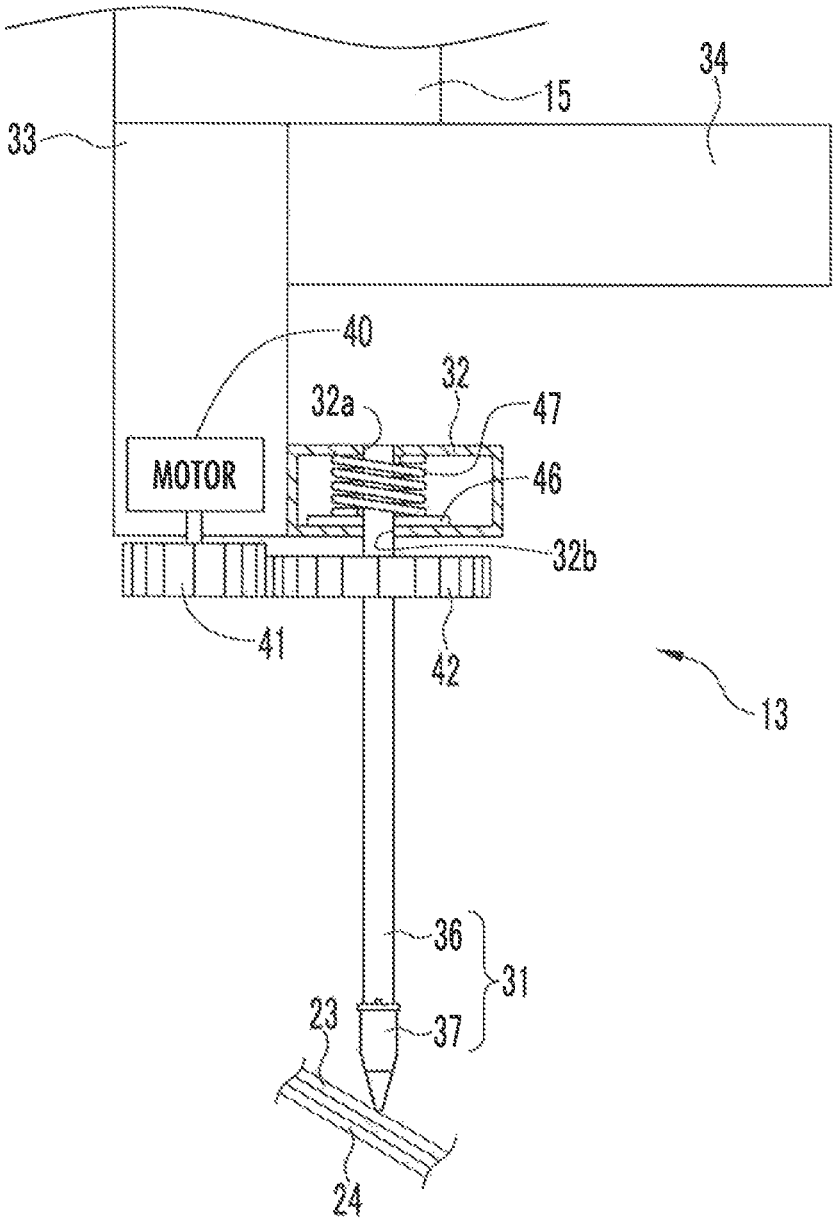
FIG. 3 is a cross-sectional view taken along line III-III showing the coating unit.

As shown in FIG. 3, the coating unit 13 comprises a nozzle unit 31, a main body portion 33 having a nozzle support portion 32 configured to rotatably support the nozzle unit 31, and a connecting portion 34 protruding from a base end portion of the main body portion 33. In FIG. 3, only the nozzle support portion 32 is illustrated in cross-sectional view, and illustrations of the sealing agent 25 and the flow channel thereof are omitted.

The nozzle unit 31 discharges the sealing agent 25, and comprises a cylindrical nozzle tube 36 and a nozzle main body 37 fixed to the tip portion of the nozzle tube 36.

Figure 5:
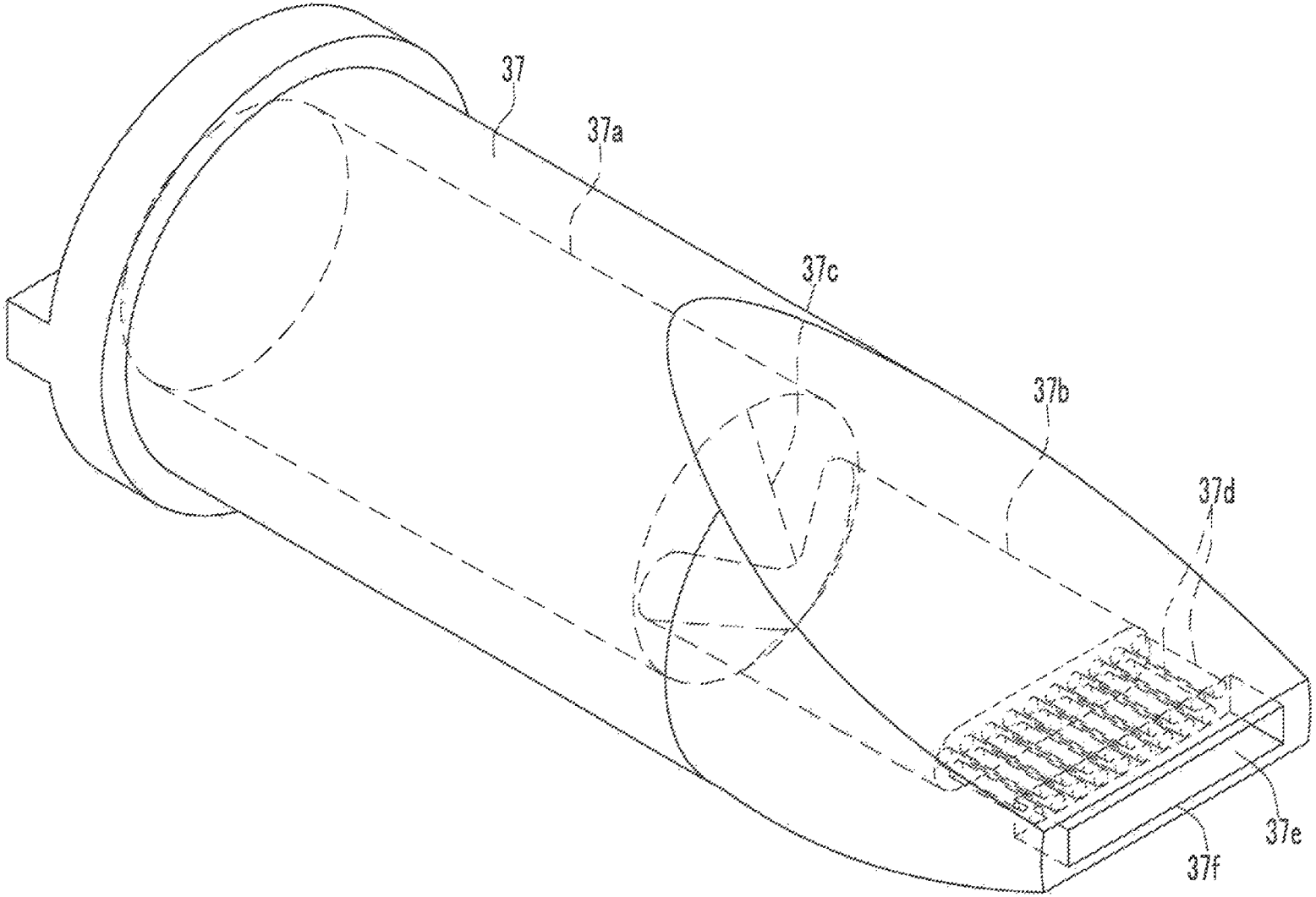
FIG. 5 is a perspective view showing a nozzle main body.

As shown in FIGS. 5 and 6, the flow channel penetrating through the inside of the nozzle main body 37 comprises a main body flow channel portion 37*a* (upstream-side flow channel portion), a first flow channel portion 37*b*, a connecting portion 37*c* configured to connect the main body flow channel portion 37*a* and the first flow channel portion 37*b*, plural (for example, nineteen) second flow channel portions 37*d*, and a chamber 37*e* (discharge portion) which is formed at the tip portion to discharge the sealing agent 25.

The nozzle main body 37 is configured so that the upstream end thereof is formed in a circular shape and the downstream end thereof is formed in an elongated quadrilateral shape. Furthermore, the nozzle main body 37 is formed so as to change from a circular shape to an elongated quadrilateral shape corresponding to the chamber 37*e* in a direction from the center portion to the downstream end side. Note that the shape of the nozzle main body 37 can be appropriately changed, and may be formed in a circular cross-section shape from the upstream end to the downstream end.

The main body flow channel portion 37*a* is formed to be circular in cross-section on an orthogonal plane orthogonal to the flowing direction of the sealing agent 25. The first flow channel portion 37*b* is formed in an elongated cross-sectional shape, and has a smaller cross-sectional shape than the main body flow channel portion 37*a*. The first flow channel portion 37*b* may be extended to the upstream end of the nozzle main body 37 without providing the main body flow channel portion 37*a*.

The connecting portion 37*c* is formed so as to change from the circular shape of the main body flow channel portion 37*a* to the elongated shape of the first flow channel portion 37*b* in a direction to the tip side (downstream end side). The chamber 37*e* is formed to have an elongated rectangular shape in cross-section.

Figure 6A:
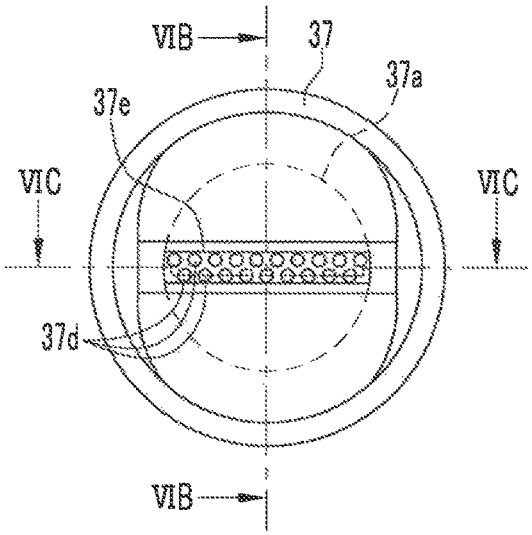
FIG. 6A is a front view showing the nozzle main body from a tip side.
Figure 6B:
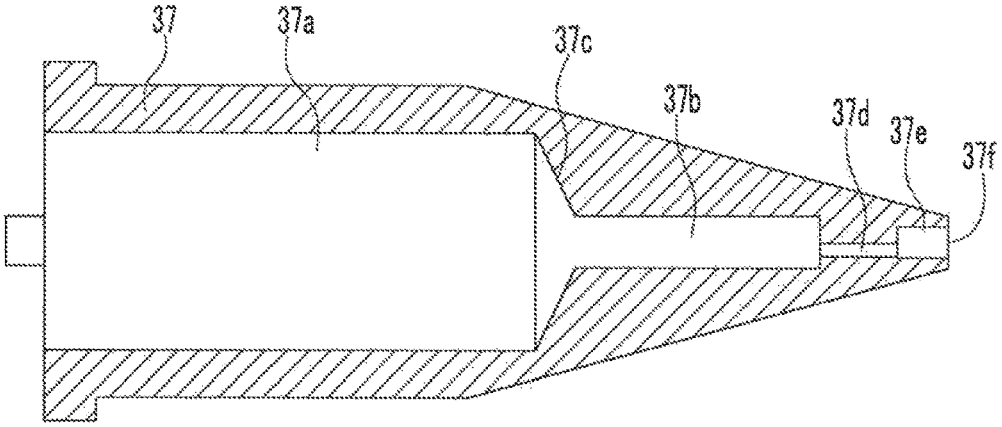
FIG. 6B is a cross-sectional view taken along line VIB-VIB showing the nozzle main body.
Figure 6C:
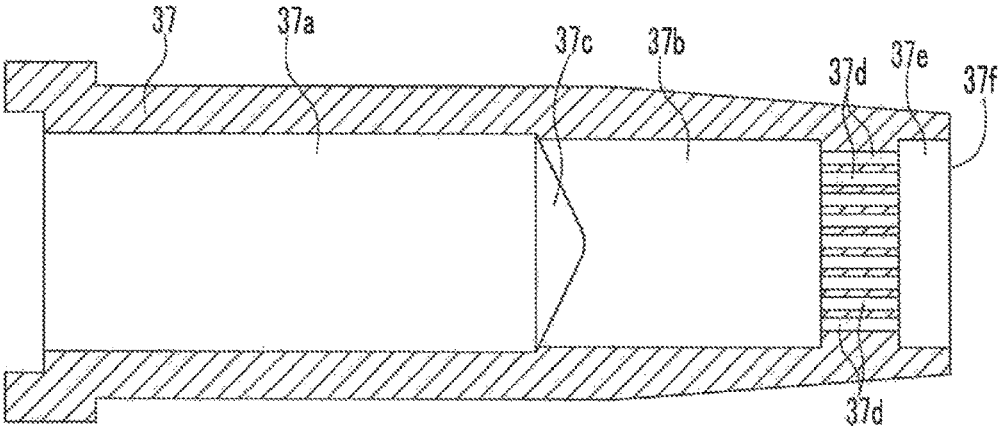
FIG. 6C is a cross-sectional view taken along line VIC-VIC showing the nozzle main body.

The plural second flow channel portions 37*d* connect the first flow channel portion 37*b* and the chamber 37*e*. As a result the sealing agent 25 sent from the nozzle tube 36 is passed through the main body flow channel portion 37*a*, the first flow channel portion 37*b*, and the plural second flow channel portions 37*d*, and sent to the chamber 37*e*. The sealing agent 25 sent to the chamber 37*e* is discharged to the outside from the nozzle port 37*f* which is an opening on the tip side of the chamber 37*e*. FIG. 6A is a front view in which the nozzle main body 37 is viewed from the tip side, FIG. 6B is a cross-sectional view taken along line VIB-VIB in FIG. 6A, and FIG. 6C is a cross-sectional view taken along line VIC-VIC in FIG. 6A.

The nozzle port 37*f* of the nozzle main body 37 is formed in a rectangular shape and has directivity. The nozzle main body 37 discharges the sealing agent 25 while being in contact with the vehicle body plate 23. The nozzle unit 31 is set so that the center axial line thereof is perpendicular to the surface of the vehicle body plate 23 in front view (FIG. 2). Note that the right-and-left direction in FIG. 2 is the longitudinal direction of the nozzle port 37*f*. Furthermore, the center axial line of the nozzle unit 31 may be inclined with respect to the surface of the vehicle body plate 23 in front view (FIG. 2).

As shown in FIG. 3, the base end portion of the nozzle tube 36 is inserted through support holes 32*a* and 32*b* formed in the nozzle support portion 32, and the nozzle unit 31 is supported by the nozzle support portion 32 so as to be rotatable around the center axial line and be capable of advancing and retreating relative to the nozzle support portion 32.

A motor 40 is disposed inside the main body portion 33. A first gear 41 connected to the motor 40 is rotatably attached to the lower surface of the main body portion 33. The first gear 41 is engaged with a second gear 42 attached to the base end portion of the nozzle tube 36. The rotation of the motor 40 is transmitted to the second gear 42 via the first gear 41, whereby the nozzle unit 31 comprising the nozzle tube 36 to which the second gear 42 is attached, and the nozzle main body 37 rotates.

A receiving plate 46 is attached to the base end portion of the nozzle tube 36. The receiving plate 46 is arranged inside the nozzle support portion 32. The receiving plate 46 is fixed to the nozzle tube 36 and receives a lower end of a coil spring 47 in which the nozzle tube 36 is inserted. An upper end of the coil spring 47 is in contact with the inner surface of an upper plate portion of the nozzle support portion 32, and the nozzle unit 31 is urged in a protruding direction (downward in FIG. 3) by the coil spring 47. In a state where the nozzle unit 31 is urged in the protruding direction, a gap is provided between the second gear 42 and the nozzle support portion 32 and the lower surface of the main body portion 33, so that the nozzle unit 31 is allowed to retreat.

The vehicle body plates 23 and 24 have convex portions which are different from the designed shapes thereof, and when the tip of the nozzle main body 37 is pushed by the convex portions, the nozzle unit 31 retreats against the urging force of the coil spring 47. As a result, even when the nozzle main body 37 is pushed by the convex portions of the vehicle body plates 23 and 24, the nozzle unit 31 can be prevented from being damaged. Note that the nozzle unit 31 may be protruded by its own weight without providing any spring.

A supply tube (not shown) of a sealing agent supply device is connected to the connecting portion 34. The supply tube is connected to a supply passage (not shown) provided inside the connecting portion 34. The sealing agent 25 supplied from the sealing agent supply device is passed through the supply tube, the supply passage of the connecting portion 34 and a supply passage (not shown) provided inside the main body portion 33, and then supplied to the nozzle tube 36 of the nozzle unit 31.

Figure 4:
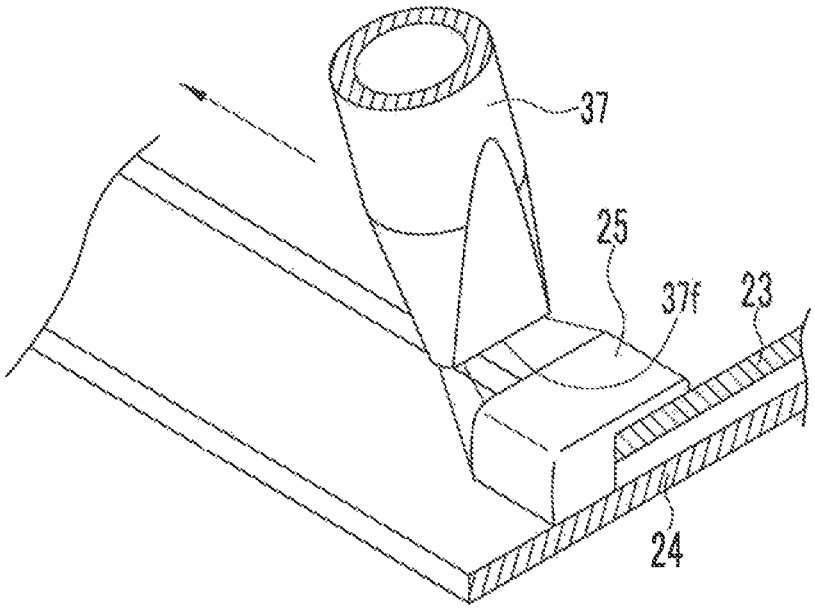
FIG. 4 is a perspective view showing a nozzle and vehicle body plates.

As shown in FIG. 4, the nozzle unit 31 is in contact with the vehicle body plate 23 while the nozzle port 37*f* is inclined with respect to the surface of the vehicle body plate 23 so that the nozzle unit 31 can discharge the sealing agent 25 while the nozzle main body 37 is in contact with the vehicle body plate 23. When the sealing agent 25 is discharged from the nozzle port 37*f* to a stepped portion of the vehicle body plates 23 and 24 under the above state, the gap between the vehicle body plates 23 and 24 is filled with the discharged sealing agent 25.

When the sealing agent 25 is applied to the gap between the vehicle body plates 23 and 24 by the coating apparatus 10, an operator operates an operation panel (not shown) to input coating execution data for driving the coating robot 11 and the motor 40 of the coating unit 13. Based on the coating execution data, the robot control device 12 drives the coating robot 11 to set the nozzle unit 31 of the coating unit 13 mounted on the mounting portion 15 at a desired position as shown in FIG. 1.

Next, as shown in FIG. 2, the coating control device 14 drives the motor 40 of the nozzle unit 31 to rotate the nozzle unit 31 until the nozzle unit 31 faces in a desired direction.

The desired position of the nozzle unit 31 is a position at which the tip surface of the nozzle unit 31 is in contact with the end portion of the vehicle body plate 23. Furthermore, the desired direction of the nozzle unit 31 is a direction in which the longitudinal direction of the nozzle port 37*f* of the nozzle unit 31 (the right-and-left direction in FIG. 2) extends to both the vehicle body plates 23 and 24 over the stepped portion between the vehicle body plates 23 and 24.

When the nozzle unit 31 is set at a desired position and in a desired direction, the sealing agent supply device is driven to supply the sealing agent 25 to the nozzle unit 31. The sealing agent 25 supplied to the nozzle unit 31 is passed through the nozzle tube 36, and sent to the nozzle main body 37. Then, as shown in FIG. 4, the sealing agent 25 sent to the nozzle main body 37 is discharged from the nozzle port 37*f* to the vehicle body plates 23 and 24. The gap between the vehicle body plates 23 and 24 is filled with the discharged sealing agent 25.

In the present embodiment, as shown in FIG. 5, the sealing agent 25 sent from the nozzle tube 36 is passed through the main body flow channel portion 37*a*, the connecting portion 37*c*, the first flow channel portion 37*b*, and the plural second flow channel portions 37*d*, sent to the chamber 37*e* and then discharged to the outside from the nozzle port 37*f* which is an opening on the tip side of the chamber 37*e*.

Since the sealing agent 25 is sent from the main body flow channel portion 37*a* having a circular cross-section shape through the connecting portion 37*c* to the first flow channel portion 37*b* which has an elongated cross-sectional shape and is smaller than the downstream end of the main body flow channel portion 37*a*, pressure is applied to the sealing agent 25 inside the first flow channel portion 37*b*. As a result, the sealing agent 25 flows vigorously from the first flow channel portion 37*b* to the second flow channel portion 37*d*.

Furthermore, since the second flow channel portion 37*d* is smaller than the downstream end of the first flow channel portion 37*b*, the sealing agent 25 in the first flow channel portion 37*b* is vigorously sent to the chamber 37*e*, and discharged from the nozzle port 37*f* to the outside. Accordingly, the discharge quantities at both end portions in the longitudinal direction of the chamber 37*e* are never smaller than that at the center portion. Accordingly, it is possible to discharge substantially the same quantity of the sealing agent 25 in the entire range of the chamber 37*e*.

The sealing agent 25 can be discharged at substantially the same velocity over the entire range of the chamber 37*e*, so that the gap between the vehicle body plates 23 and 24 can be filled evenly. Particularly, a sufficient quantity of the sealing agent 25 can be applied to the vehicle body plate 24 on a farther side from the nozzle main body 37 while the coating quantity (heaping quantity) of the sealing agent 25 to be applied to the vehicle body plate 23 on a closer side to the nozzle main body 37 is maintained at an appropriate thickness.

In the above embodiment, the nozzle main body 37 discharges the sealing agent 25 while being in contact with the vehicle body plate 23, but a gap may be provided between the nozzle main body 37 and the vehicle body plate 23.

Furthermore, the cross-sectional shapes of the main body flow channel portion 37*a* and the first flow channel portion 37*b* are not limited to the circular shape and the elongated shape, and may be appropriately changed.

Furthermore, the material to be discharged from the nozzle is not limited to the sealing agent, and it may be any material insofar as it has viscosity.

REFERENCE SIGNS LIST

10 . . . coating apparatus, 11 . . . coating robot, 12 . . . robot control device, 13 . . . coating unit, 14 . . . coating control apparatus, 15 . . . mounting portion, 21 . . . support portion, 23, 24 . . . vehicle body plate, 25 . . . sealing agent, 31 . . . nozzle unit. 32 . . . nozzle support portion, 33 . . . main body portion, 34 . . . connecting portion, 36 . . . nozzle tube, 37 . . . nozzle main body, 37*a* . . . main body flow channel portion (upstream-side flow channel portion), 37*b* . . . first flow channel portion, 37*c* . . . connecting portion, 37*d* . . . second flow channel portion, 37*e* . . . chamber (discharge portion), 37*f* . . . nozzle port, 40 . . . motor, 41, 42 . . . first, second gear, 46 . . . receiving plate, 47 . . . coil spring

The invention claimed is:

1. A coating apparatus comprising a nozzle having a flow channel therein, the nozzle configured to discharge a viscous material flowing through the flow channel to apply the viscous material discharged from the nozzle to an object, wherein the flow channel comprises:

a first flow channel portion through which the viscous material flows, the first flow channel portion having a rectangular shape in cross-section on an orthogonal plane orthogonal to a flowing direction of the viscous material through the flow channel;

a plurality of second flow channel portions which are smaller than a downstream end of the first flow channel portion and intercommunicate with the downstream end of the first flow channel portion so as to cause the viscous material flowing from the first flow channel portion to flow therethrough;

a discharge portion that intercommunicates with downstream ends of all of the plurality of second flow channel portions and discharges the viscous material flowing from the plurality of second flow channel portions;

an upstream-side flow channel portion provided at an upstream side of the first flow channel portion, the upstream-side flow channel portion having a circular shape in cross-section on the orthogonal plane, and the upstream-side flow channel having a longer cross-sectional diameter on the orthogonal plane than a cross-sectional length of an upstream end of the first flow channel portion on the orthogonal plane, and causes the viscous material to flow to the first flow channel portion; and a connecting portion which is inclined and configured to connect the upstream-side flow channel portion and the first flow channel portion.

2. The coating apparatus according to claim 1, wherein a downstream end of the discharge portion is formed in elongated rectangular shape, an upstream end of the nozzle is formed in a circular shape, and a downstream end of the nozzle is formed in a rectangular shape corresponding to the discharge portion.

* * * * *